United States Patent [19]

Beno

[11] 3,961,386

[45] June 8, 1976

[54] TOILET SEAT COVER

[76] Inventor: Ferdinand Beno, 3548 W. 25th St., Chicago, Ill. 60623

[22] Filed: Mar. 27, 1974

[21] Appl. No.: 455,347

[52] U.S. Cl. ..... 4/247
[51] Int. Cl.[2] ..... A47K 13/18
[58] Field of Search ..... 242/55.2, 55.3, 55.53; 4/242–247

[56] References Cited

UNITED STATES PATENTS

| | | | |
|---|---|---|---|
| 1,515,700 | 11/1924 | Rees | 4/247 |
| 1,516,803 | 11/1924 | Wheeler | 4/247 |
| 1,911,517 | 5/1933 | Lanspa et al. | 4/247 |
| 1,967,581 | 7/1934 | Macias | 4/247 |
| 2,002,948 | 5/1935 | Joriot | 4/247 |
| 2,024,088 | 12/1935 | Benson | 4/247 |
| 2,987,732 | 6/1961 | Speese | 4/247 |

FOREIGN PATENTS OR APPLICATIONS

| | | | |
|---|---|---|---|
| 529,406 | 6/1957 | Belgium | 4/243 |
| 914,181 | 6/1954 | Germany | 4/243 |

*Primary Examiner*—Leonard D. Christian

[57] ABSTRACT

Apparatus for moving a strip of sanitary sheet material over the top of a toilet seat, having two rollers, one for supply and one for take-up. Floor engaging legs and absence of any connection to the toilet fixture and a transverse connection only at the front end make the assembly adaptable for use with any type of toilet assembly and enables the assembly to be slid out of position with respect to a toilet fixture for cleaning or maintenance purposes.

6 Claims, 7 Drawing Figures

TOILET SEAT COVER

This invention relates to apparatus for use with any form of standard toilet fixture, and particularly an apparatus for providing a continuous supply of sanitary cover for the toilet seat.

The problem of providing sanitary covers for toilet seats in public toilets has never had a completely satisfactory solution.

The object of the present invention is to provide an apparatus that will provide a sanitary toilet seat cover from a continuous strip of rolled sanitary sheet material.

It is the object to provide such an apparatus that is flexible and portable to the extent that it is not fixedly attached directly to the toilet fixture and can be used with any form of toilet fixture, whether floor mounted or wall mounted.

It is a further object to provide an apparatus that rests upon the floor, and can be readily removed from position in order to perform normal maintenance cleaning operations.

The construction of the invention is described in the accompanying drawings wherein.

The apparatus of this invention consists of four substantial parts, namely, the supporting construction, two carriers for rolls of strip material, the operating mechanism, and the strip of rolled sanitary sheet material.

Figure 1:
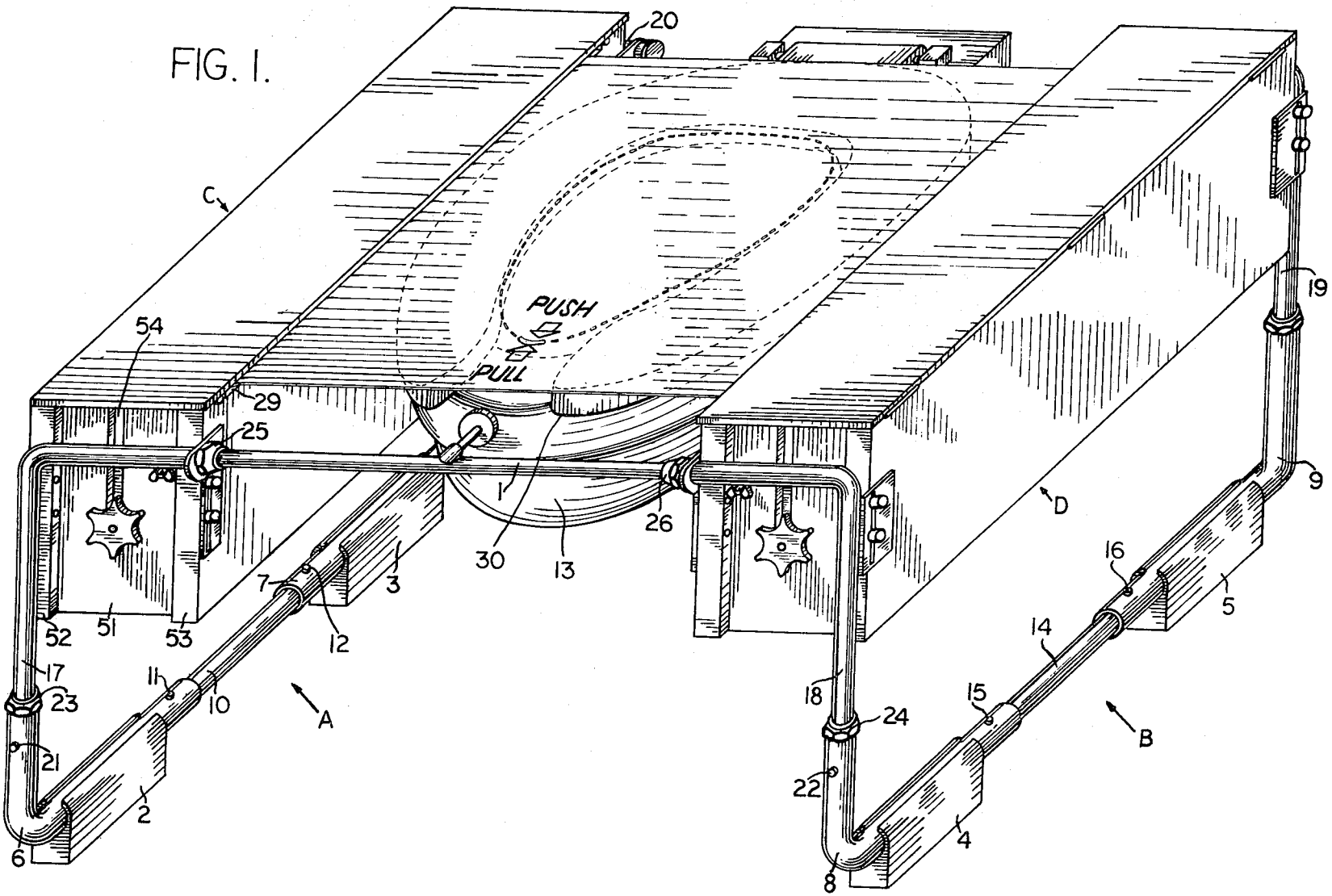
FIG. 1 is a perspective view of the apparatus in place with a typical toilet fixture.
Figure 2:
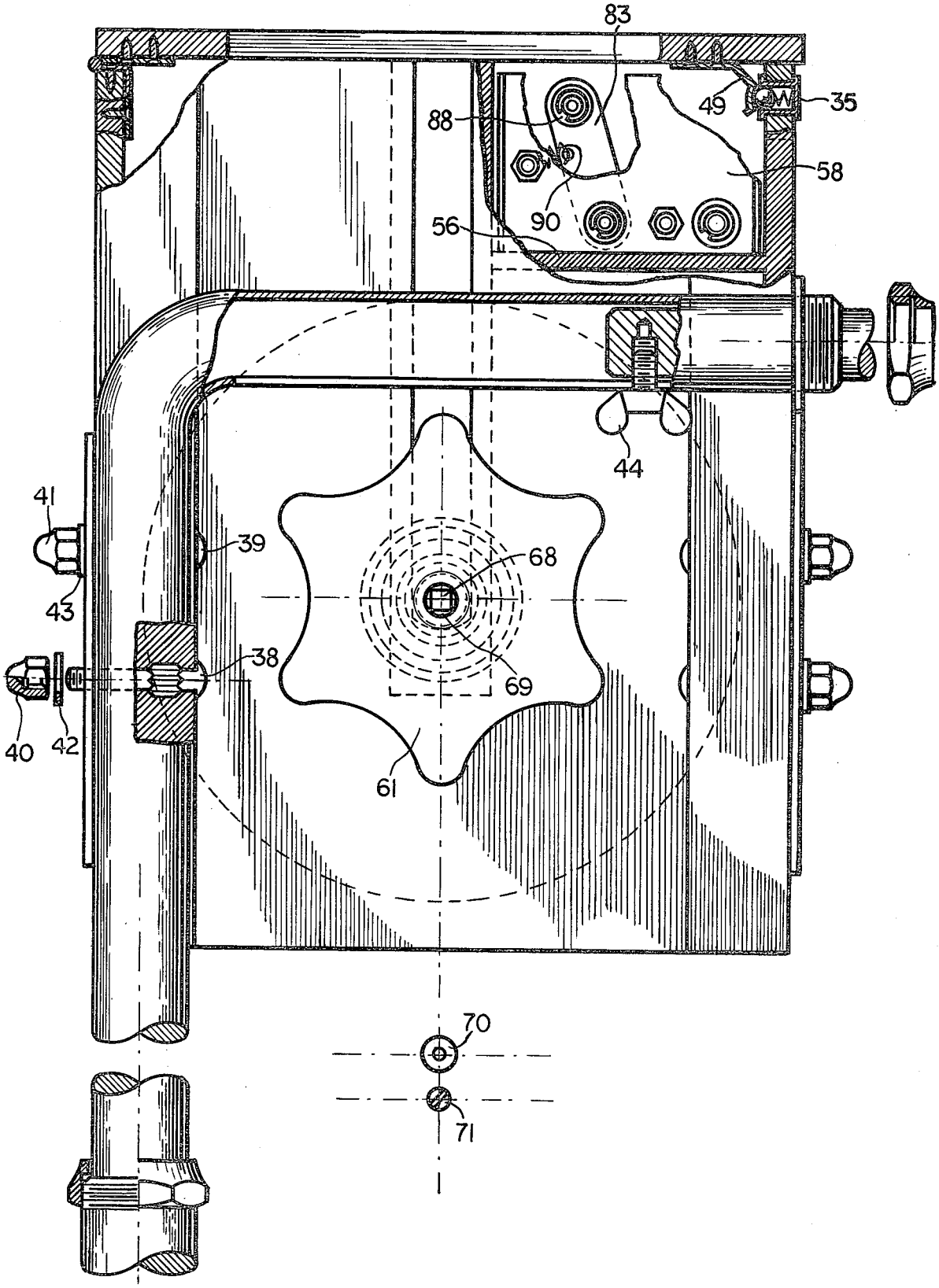
FIG. 2 is a front left view of a portion of the assembly.
Figure 4:
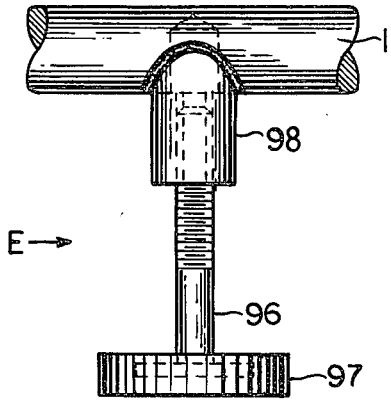
FIG. 4 is a detail of a spacing adjustment disposed on the front of the assembly.

Having reference to FIG. 1, the apparatus is divided into parts A and B which are joined together at the front end of the construction by a connecting rod 1. In the center of this rod is located a spacer E which is adjustable and adapted for engaging the front end of a toilet fixture. The spacer E may include a rubber pad 97 attached to the head of a screw 96 which is engaged with a member 98 as shown in FIG. 4. The connecting rod is formed of telescoping sections for adjusting the width of the assembly, and the sections are secured by a wing head screw 44 as shown in FIG. 2. The connecting rod is adjusted as to its length for any particular toilet fixture installation with which the assembly might be used.

There is no cross connection between the side portions of the assembly at the rear in order to provide ready removal of the assembly by sliding it forward.

The left and right portions of the assembly are supported on a floor and may employ four rubber foot members 2, 3, 4 and 5 which are secured to horizontal leg members 6, 7, 8 and 9. The function of the feet members is to provide traction with the floor so that the assembly will be relatively stable.

Horizontal leg members 6 and 7, as shown in the left side of the construction, are connected by telescoping rod 10 secured by screws 11 and 12. The right side of the construction is similar. This adjustable feature of the leg members makes it possible to vary the length of the leg members to accommodate different sizes of toilet fixtures with which the assembly is to be used.

Support members 17, 18, 19 and 20 engage upright portions of the leg members in a telescoping manner, and the respective members are secured by means of screws, such as 21 and 22. This enables a vertical adjustment of the assembly to accommodate the particular height of a toilet fixture with which the apparatus is intended for use. Nuts 23 and 24 may be used in connection with tapering threads in order to provide vertical adjustment as well as decorative effect.

The nuts 25 and 26 associated with cross member 1 serve the same function.

Figure 5:
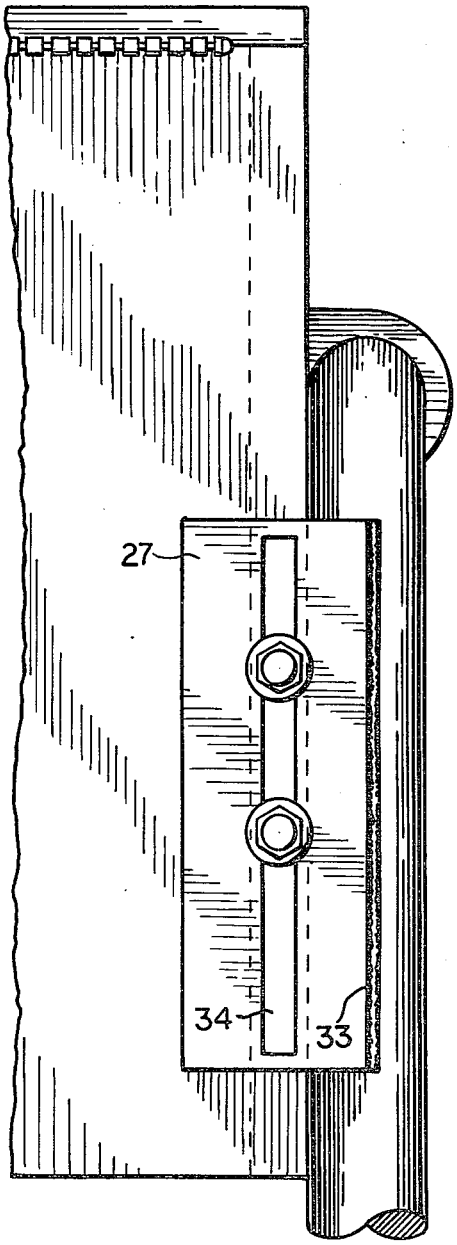
FIG. 5 and FIG. 6 show details of the adjusting mechanism of the construction.

Containers C and D are supported on the support members 17, 18, 19 and 20. Hinge brackets 27 and 28 can be used for securing purposes. The hinge bracket 27 shown in FIG. 5 is welded to the support member 18, in another form of the construction. The hinge bracket 27 includes slot 34 and carriage bolts and nuts are used to engage the containers with the slotted bracket, the slot enabling adjustments at a proper height to accommodate a particular toilet seat for which the apparatus will be used.

Figure 6:
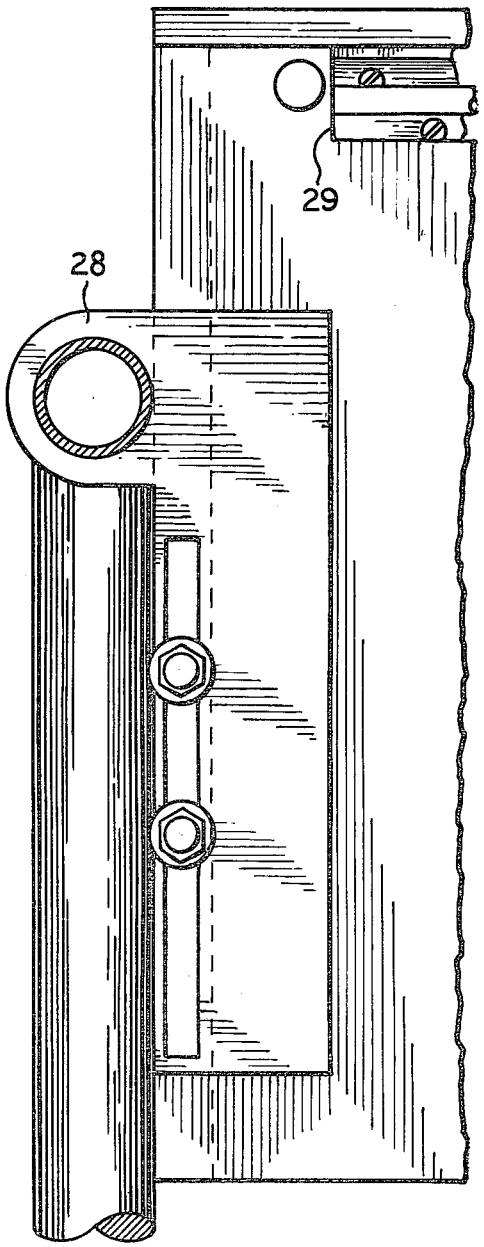

A variation of the hinge back bracket connection between the container and support member is shown in FIG. 6 where bracket 28 includes an upper tab 28 through which the support member passes, so that welding of the hinge bracket is not necessary.

The two containers of the apparatus are generally rectangular in configuration. The top wall of the container forms a cover which is secured by latches and band springs 49 as shown in FIG. 2.

Figure 3:
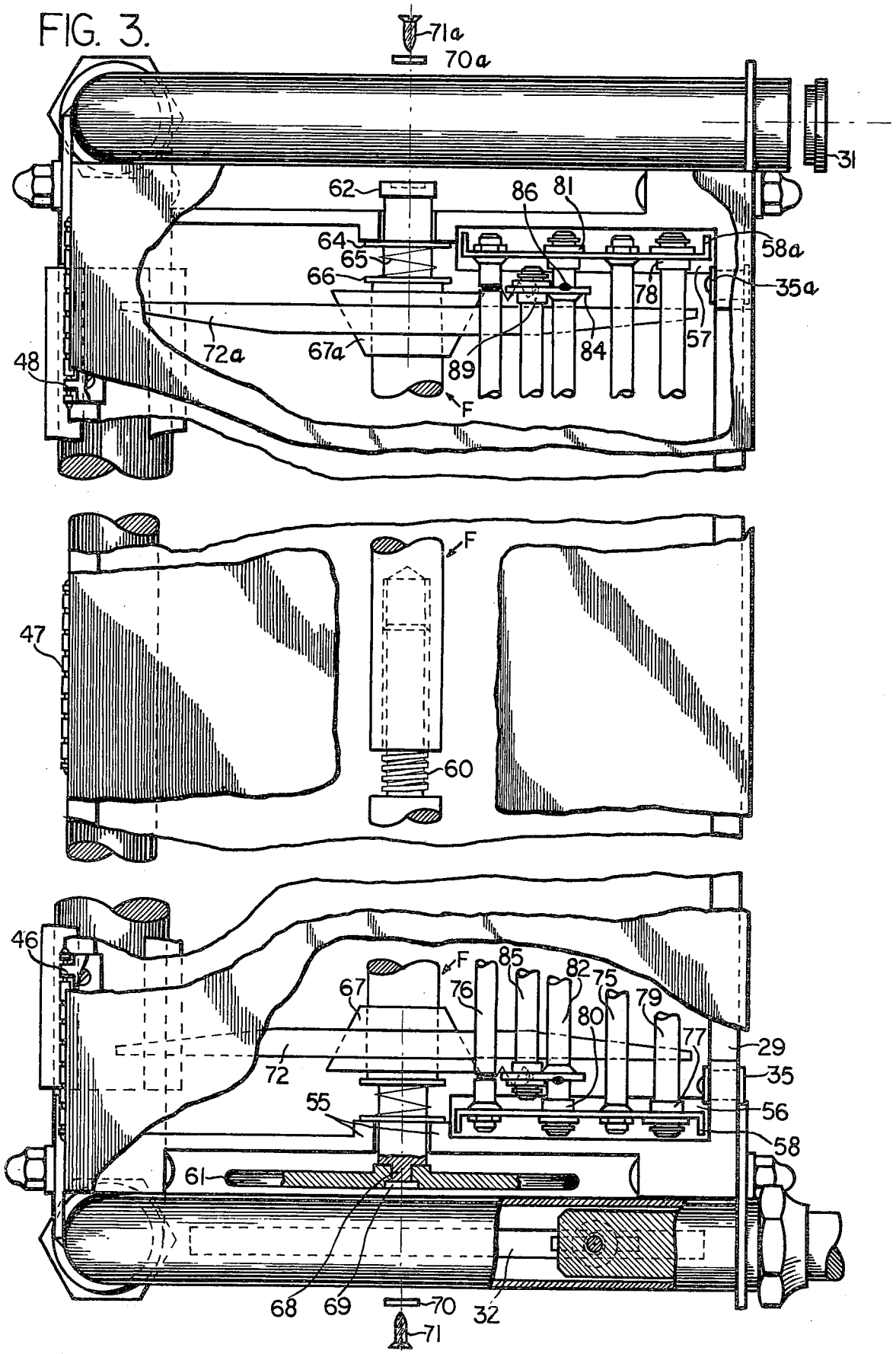
FIG. 3 is a top view of a portion of the assembly.

The left container C contains a front wall 51 as shown in FIG. 1 with corner portions 52 and 53. The front wall includes a slot 54 extending vertically and opened at its upper end. This slot accommodates a shaft of a roll. FIG. 3 shows the top view of the container construction. A set-off 56 provides a support for frame 58 of the tension mechanism for the strip rolled which will be described later. The front and rear parts of the right container are similar in construction, but the set-off for the frame of the tension mechanism must necessarily be reversed. Three hinges 46, 47 and 48 are shown in FIG. 3 being on the left wall of the container and connect the top cover to the side wall of the container. On the right wall of the left container, at the upper end, is a slot 29 to accommodate the strip material coming from one container and extending over to the opposite container. Cover latches 35 and **35*a*** serve to keep the top cover of the container in closed position.

The right container D is similar in construction to the left container C.

The operating mechanism of the apparatus will now be described.

Figure 7:
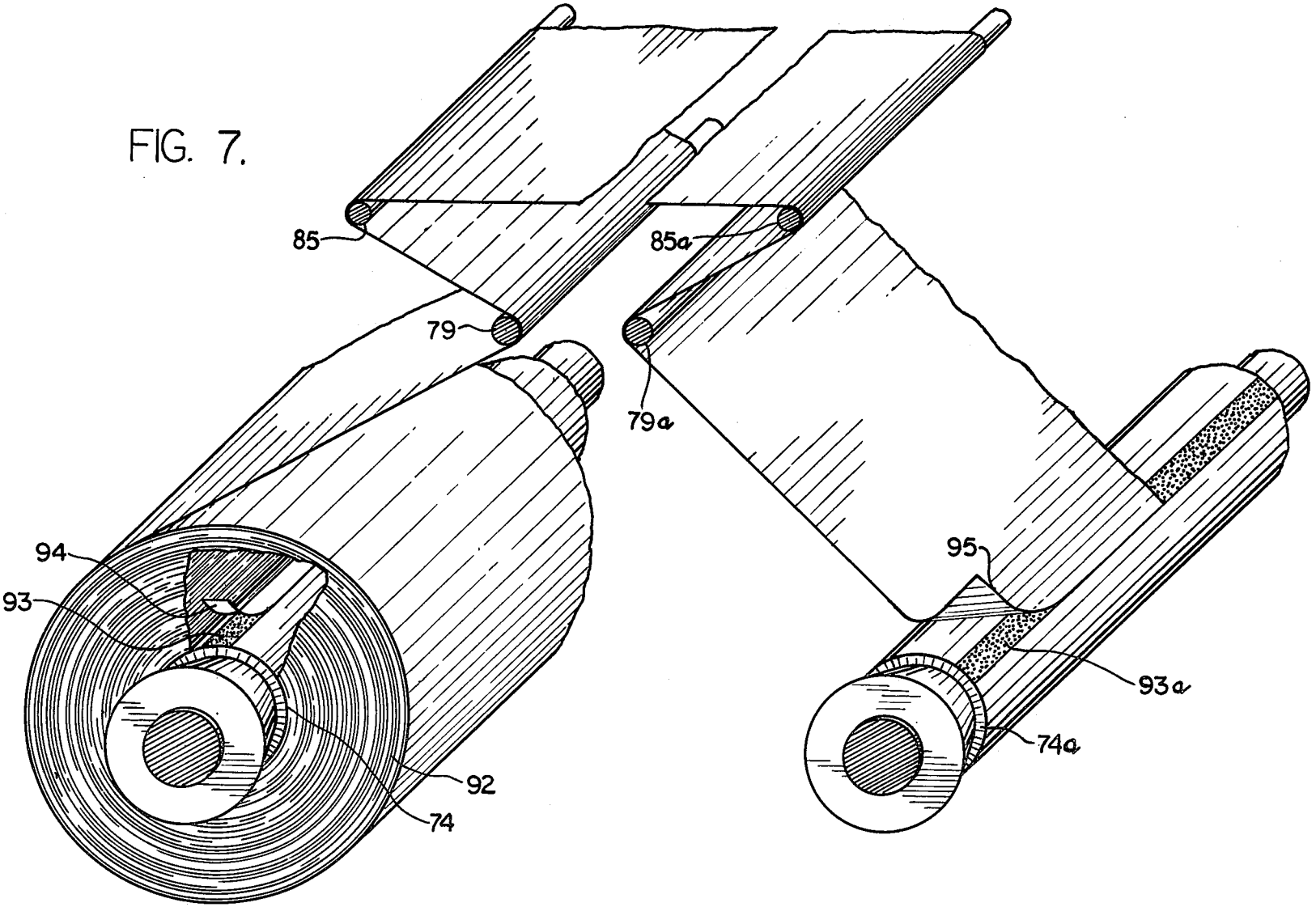
FIG. 7 illustrates the manner of threading the strip of paper on the rolls.

The slot in the front and rear walls of the left container accommodate the shaft F of a paper roll, as shown in FIG. 3. This shaft consists of two parts or sections threaded together as at 60 in FIG. 3. The strip of sanitary material is wound on the spool 74, as shown in FIG. 7. By tightening the interconnecting thread 60 of shaft, the shaft length becomes shorter and the spool of paper will press against end cones 67 and **67*a* as shown in FIG. 3. The end cones are made of soft rubber. The tightening-up process will continue until the spool will contact the guides 72 and 72*a*** that is also connected to each end of the shaft, concentric with the rubber cone.

The cones are mounted on the shaft, and the guides are mounted on the cones. The front end of the shaft includes an adjusting hand reel 61 as shown in FIGS. 2 and 3. This wheel is secured to the shaft by any suitable means as shown at 68, 70, 71. The opposite ends of each shaft also include a friction brake which consists of plain washers, 64 and 66, with interposed compressed spring 65. This assembly serving to maximize the drag friction of the roll in the assembly.

The tension mechanism for the rolled strip material utilizes a frame 58 at the front end and at the back end of the container. The frames are connected together by rods 75 and 76 disposed parallel to the axis of the roller. In the frames are inserted bearings 77 and 78 as shown in FIG. 3, for thread shaft 79. Bearings 80 and 81 accommodate support shaft 82. Tension arms 83, 84 are attached to arms 83, 84 which are connected to turn shaft 85. The support arms are welded on the support shaft 82 at 86. Turn shaft 85 is inserted in bearings 88, 89. Tension on the strip material is provided by turn shaft 85, the ends of which are connected to arms 83, 84. Arms 83, 84 are mounted for pivoted movement and are spring loaded by spring 90.

The roll of strip material consists of a carrying spool 74 as shown in FIG. 7 on which is wound the strip material 92. The spool contains an adhesive material to which the end of the strip material is secured.

Of course, there are two similar rolls or rollers in the entire assembly, one being adapted for supply and the opposite being adapted for take-up.

From the foregoing description it can be appreciated that the apparatus can be constructed of any form of material whether metal, wood, plastic, or combinations of these.

The sanitary strip material will most usually be of paper, but any similar material could be used, final selection being made upon the basis of cost and availability.

Servicing of this assembly provides the upmost of simplicity and no training is required for installation or servicing. For installation of a paper roll, it is merely necessary to set the roll of paper into the left container, to thread the strip over the guide rolls, to the opposite container, over the similar guide rolls and to attach the end of the strip to the roller, after installation and threading, the position of the strip material is accomplished by adjusting the manual control wheels 61. The amount of strip material moved can be regulated by turning the wheels as necessary.

The strip of sanitary material is preferably provided with successive perforated portions conforming to the opening in a usual toilet seat. A tab for easy grasp by the fingers permits tearing of the perforated portions from the strip. Adjustment of the opening in the strip over the toilet seat is accomplished by the hand wheels. Before each use, a new section of strip material is moved into place, with the perforations centered over the toilet seat. It will be appreciated that after each use, the strip will be moved to the next succeeding position until the supply roll is exhausted and all of the soiled strip is accumulated on the take-up roller.

I claim:

1. An apparatus for providing a sanitary cover for a toilet seat having dual parallel rollers adapted to accommodate a strip of sanitary covering material and disposed on opposite sides of said seat, and crank means connected to each of said rollers for moving the sanitary covering material across the top of said seat;

the improvement consisting of, floor engaging U-shaped leg members having front and back ends and being disposed on opposite sides of said seat, upright support means connected to the front and back ends of each of said leg members, means for connecting front and back ends of said rollers to respective front and back ends of said upright support members, and frontally disposed transverse connecting means extending between the front ends only of said roller connecting means and being disposed at a lower level than said seat.

2. Apparatus as claimed in claim 1 wherein each of said roller connecting means comprises a roller mounting assembly and parallel guide and tension bars for the strip of covering material.

3. Apparatus as claimed in claim 1 wherein said transverse connecting means includes a backwardly directed stop member for limiting the backwardmost position of the apparatus over said seat.

4. Apparatus as claimed in claim 1 wherein said upright support members include means for adjusting the height of the assembly with respect to a particular seat with which the assembly is to be used.

5. Apparatus as claimed in claim 1 wherein said transverse connecting means includes means for adjusting the horizontal spacing between said rollers to accommodate a particular seat with which the assembly is to be used.

6. Apparatus as claimed in claim 1 comprising a strip of sanitary covering material the opposite ends of which are connected to respective ones of said rollers, said covering material including longitudinally, sequencially spaced sets of perforations in the approximate shape of the opening in said seat, and tab means to permit ready manual tearing of the perforated portion from the strip.

* * * * *